US005375488A

United States Patent [19]

Baitner

[11] Patent Number: 5,375,488

[45] Date of Patent: Dec. 27, 1994

[54] NAIL HOLDING AND GUIDING DEVICE

[76] Inventor: Yoav Baitner, Shenkin 83/8, Givatayim, Israel

[21] Appl. No.: 87,492

[22] Filed: Jul. 6, 1993

[30] Foreign Application Priority Data

Jul. 16, 1992 [IL] Israel ..... 102543
Dec. 3, 1992 [IL] Israel ..... 103985

[51] Int. Cl.[5] ..... B25C 3/00
[52] U.S. Cl. ..... 81/44; 294/99.2
[58] Field of Search ..... 294/28, 99.1, 99.2; 81/44, 487, 489, 177.3, 177.6, 418, 420, 424.5, 426.5, 427, 427.5, DIG. 6, 300, 393

[56] References Cited

U.S. PATENT DOCUMENTS 389,925 9/1888 Griscom ..... 294/99.2 X
838,662 12/1906 Stephens ..... 294/99.2
1,976,623 10/1934 Monroe et al. ..... 294/99.2 X
2,475,208 7/1949 Thureen ..... 81/300 X
2,716,750 9/1955 Biblis .
3,293,958 12/1966 Smith ..... 294/99.2 X
3,729,035 4/1973 Manzanarez .
4,079,765 3/1978 Hatayau .
4,201,258 5/1980 Elmore et al. .
4,221,248 9/1980 Rix .
4,261,608 4/1981 Bradshaw ..... 294/99.2 X
4,390,050 6/1983 Whitney .
4,493,353 1/1985 Thomas .

FOREIGN PATENT DOCUMENTS 0182285 3/1907 Germany ..... 81/44
3420366 12/1985 Germany .
3911002 10/1990 Germany .
0563843 7/1975 Switzerland ..... 81/44

*Primary Examiner*—D. S. Meislin

[57] ABSTRACT

A nail guide and holding device comprises two elongated members pivotally connected to one another at one end and having finger grips at the other end. The elongated members having upper faces and bottom faces defining a bottom plane and inner side faces facing each other. The inner side faces having a portion being essentially perpendicular to the bottom plane. V-shaped grooves are provided for holding a shank of a nail. The V-shaped grooves have a front side and a rear side, wherein one of the sides is longer than the other of the sides.

24 Claims, 6 Drawing Sheets

NAIL HOLDING AND GUIDING DEVICE

FIELD AND BACKGROUND OF THE INVENTION

The present invention concerns a device for holding and guiding a nail during driving same into a substrate with a hammer. Such a device will be referred to herein at times, for the sake of convenience, as "nail guide".

Various nail guides are known in the art such as those disclosed in U.S. Pat. Nos. 2,716,750, 3,729,035, 4,079,765, 4,201,258, 4,221,248 and 4,390,050. Each of such nail guides has various drawbacks as will be appreciated from realizing the advantages of the nail guide of the invention which will be revealed in the following description.

GENERAL DESCRIPTION OF THE INVENTION

The present invention provides a nail guide comprising two elongated members pivotally connected to one another at their one end and having each a finger grip at their other end; the two members have upper and bottom faces, the bottom faces defining a bottom plane and having inner side faces one facing the other, at least a portion of the inner side faces proximal to said one end being essentially perpendicular to said bottom plane; said portion of one member and said portion of another member capable of cooperating to hold together a shank of a nail therebetween when the two members are being pressed against one another.

The present invention also provides a nail guide comprising two elongated members connected to one another at their one fixed end by a connecting means allowing the two members to pivotally rotate with respect to one another about their said one end, and having each finger grip at their rear end; the two members have upper and bottom faces, the bottom faces defining a bottom plane and having inner side faces one facing the other, at least a portion of the inner side faces proximal to said front end being essentially perpendicular to said bottom plane; said portion of one member and said portion of another member being capable of cooperating to hold together a shank of a nail therebetween when the two members are being pressed against one another.

By one embodiment of the present invention said connecting means is a pivot cooperating with bored front end portions of the two members. By another embodiment of the invention the connecting means is a flexible connecting member integral with the front end of the two members.

Preferably said portion of at least one of the members has one or more essentially V-shaped grooves adapted to hold a shank of a nail. Suitably each such groove is opposite to another such groove in the other member, a pair or such essentially V-shaped grooves being capable of cooperating to hold together a shank of a nail.

Each such grooves or pair of essentially V-shaped grooves is suitable by its nature to hold and guide shanks of nails having a range of diameter. For example, a pair of grooves having each a width of about 2.2 mm and a depth of about 0.9 mm are suitable for holding and guiding together shanks of nails ranging in diameter between 1.6 to 3.0 mm; a pair of grooves having each a width of about 1.4 mm and a depth of about 0.55 mm are suitable for holding together shanks of nails ranging in diameter between 0.9 to 1.6 mm.

If desired, said portion of the inner faces may have a plurality of V-shaped grooves, each adapted to hold shanks of a nail of a different diameter range.

The connecting means may easily be damaged when hit by a hammer. In order to prevent such damage, a portion of the upper face flanking said portion of the inner face is elevated above the level of the upper face at the point of connection between the two members, whereby even when the nail is driven to a position in which its head rests on the upper face of the guide, a hammer hit will not cause damage.

The finger grips of the nail guide may be any one of a large number of types of such grips. One preferred type of a finger grip is that having a concave surface formed between bottom, inner side and front walls, which merge smoothly with one another. Such a grip allows a convenient simultaneous provision of a grasping pressure to firmly hold the shank of a nail and a downward pressure to stabilize the device against a substrate.

The essentially V-shaped grooves may be perpendicular to said bottom plane and thus suitable for holding and guiding a nail in a direction perpendicular to the substrate's surface; but it is also possible to have such grooves angled to allow the driving of a nail in a direction other than perpendicular.

The nail guide is suitably made of plastic. The plastic is preferably transparent, at least at portions of the nail guide flanking the portions which hold the nail shank. Such transparency facilitates the proper aiming of the nail to the appropriate point on the surface of the substrate.

BRIEF DESCRIPTION OF THE DRAWINGS

Specific embodiments of the present invention are illustrated in the drawings, in which.

DETAILED DESCRIPTION OF THE INVENTION

Figure 1:
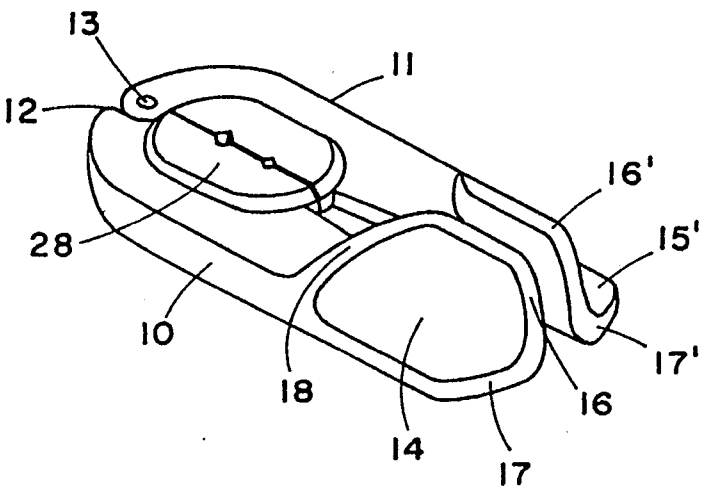
FIG. 1 shows a perspective view of a nail guide in accordance with one embodiment of the present invention.
Figure 8:
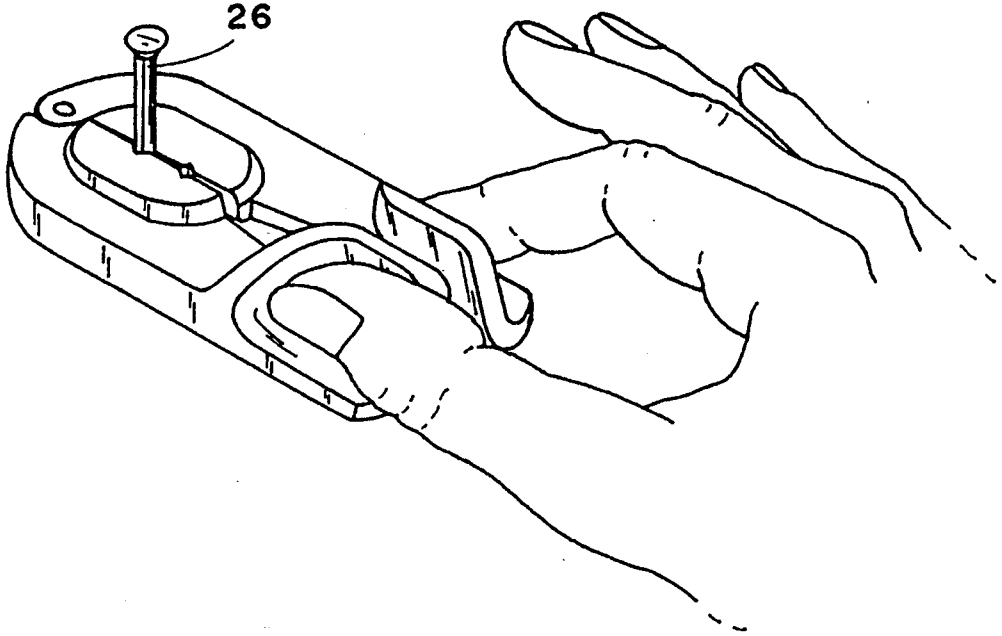
FIG. 8 shows the nail guide in use.
Figure 2:
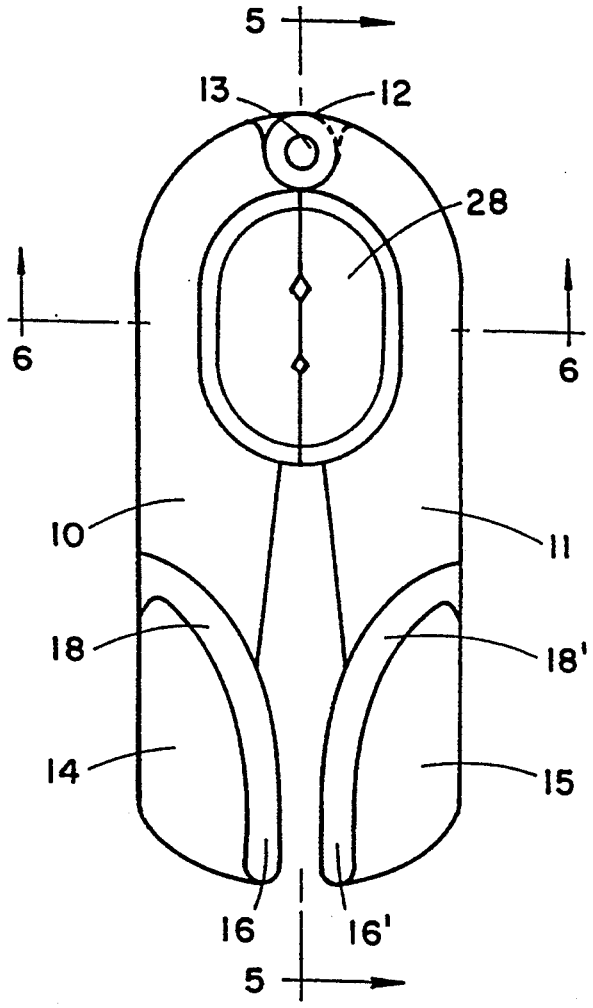
FIGS. 2, 3 and 4 show upper, side and rear views of the nail guide of FIG. 1, respectively.
Figure 3:
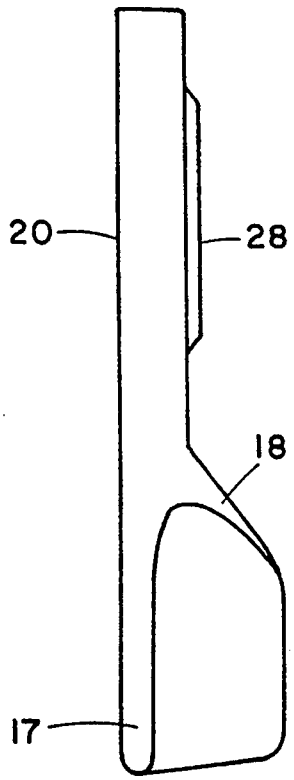
Figure 4:
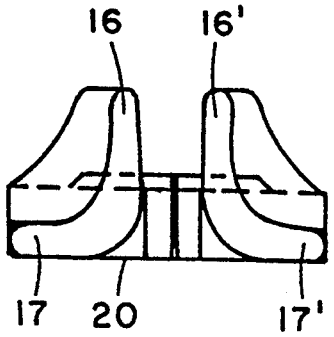

The invention will now be illustrated with reference to a specific, non-limiting embodiments depicted in the annexed drawings. It will be readily appreciated by the artisan that various other embodiments within the scope of the invention as defined herein may be envisaged.

The nail guide shown in FIGS. 1–4, has two elongated members 10 and 11 pivotally connected to one another at their front end 12 by means of pivot 13. While in the embodiment shown herein the pivot is a separate member, the pivot may also be integrated with one of the members and fitted into a suitable bore in the other member. Each of the elongated members 10 and 11 has a respective finger grip 14 and 15 having each a concave surface formed between side 16 and 16', bottom 17 and 17' and front 18 and 18' walls, smoothly merging with one another.

The bottom face of the nail guide defines a bottom plane 20 which is use is pressed against the surface of the substrate into which the nail is to be driven.

Figure 5:
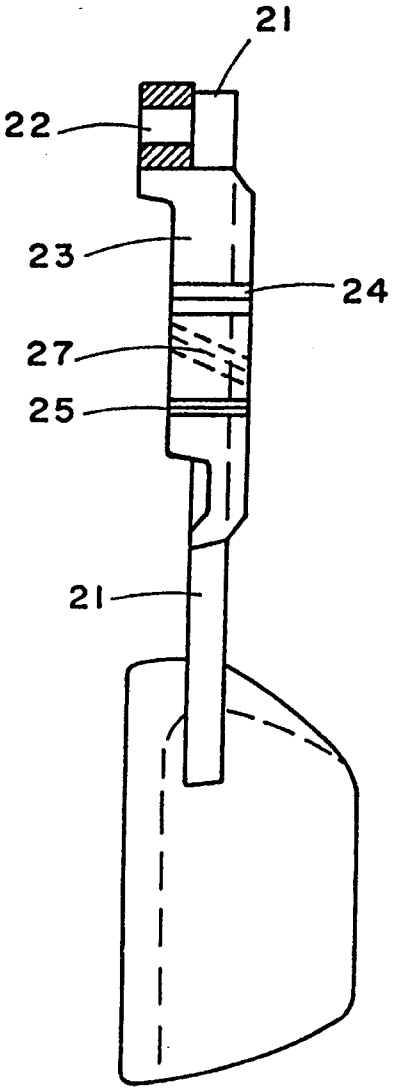
FIG. 5 shows a cross-sectional view through line 5—5 in FIG. 2.
Figure 7:
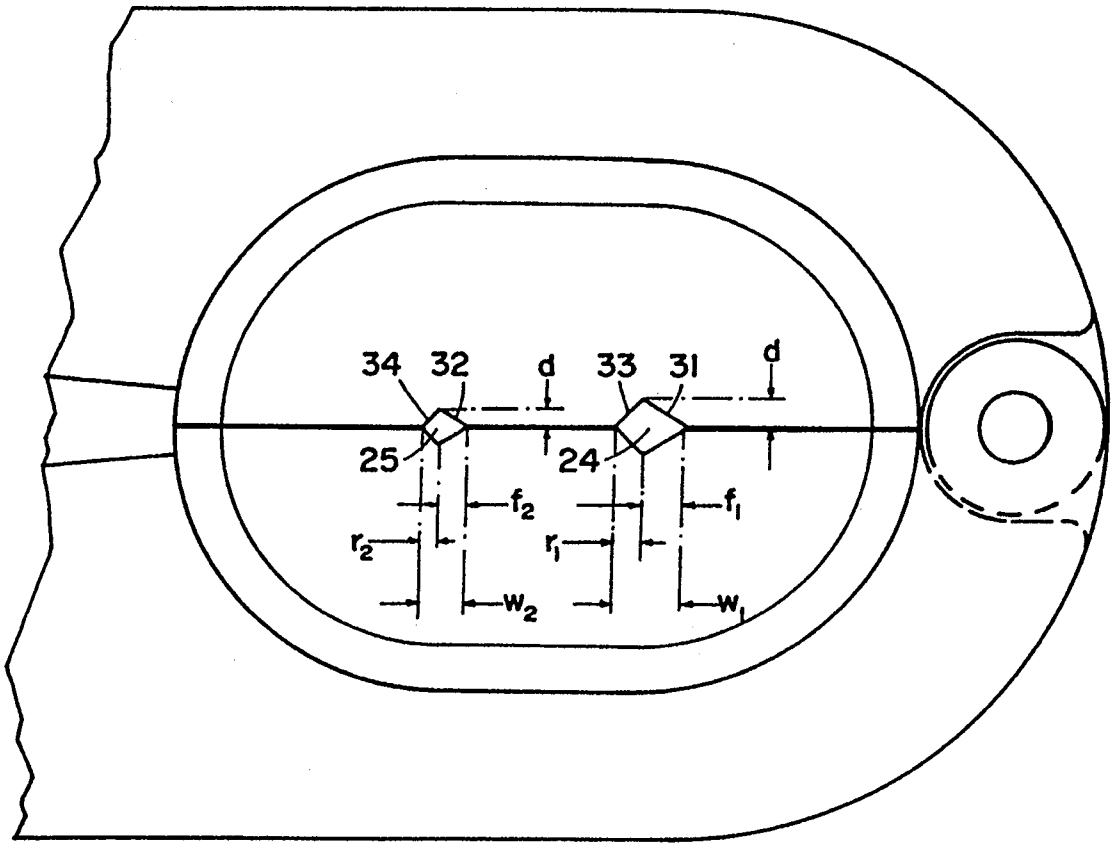
FIG. 7 shows an enlargement of the front end portions of the nail guide.
Figure 9:
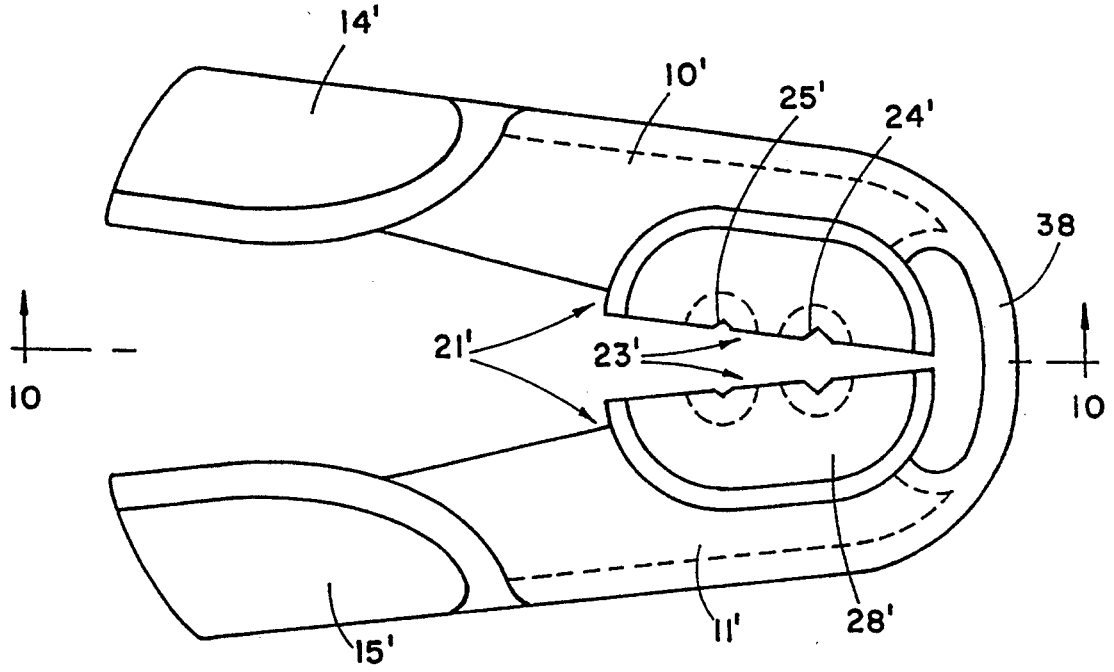
FIG. 9 is an upper view of a nail guide in accordance with another embodiment of the invention.
Figure 10:
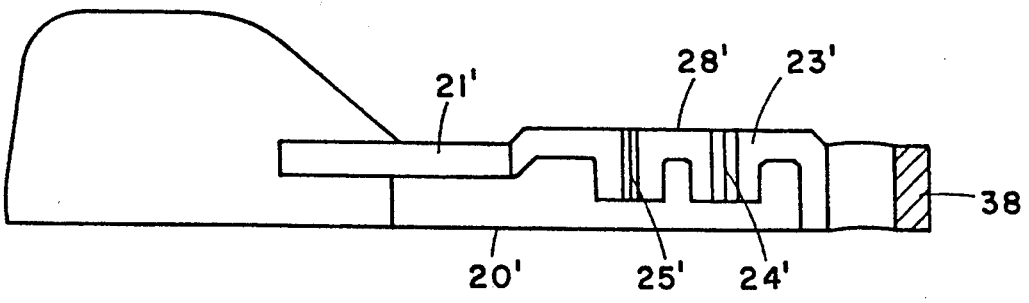
FIG. 10 is a cross-sectional view through line 10—10 in FIG. 9.
Figure 12:
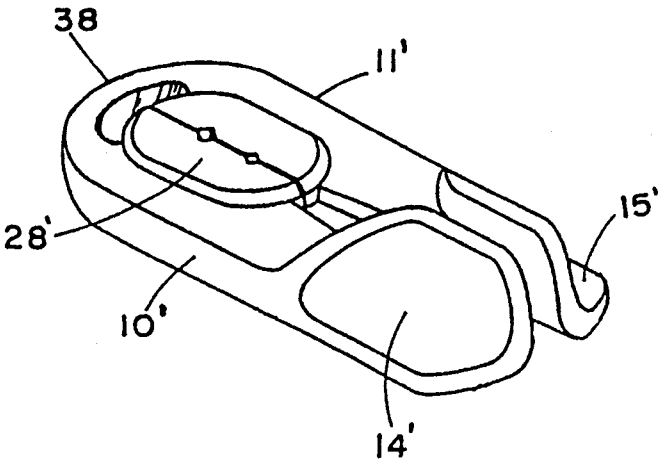
FIG. 12 shows the nail guide of FIG. 9 in use.
Figure 11:
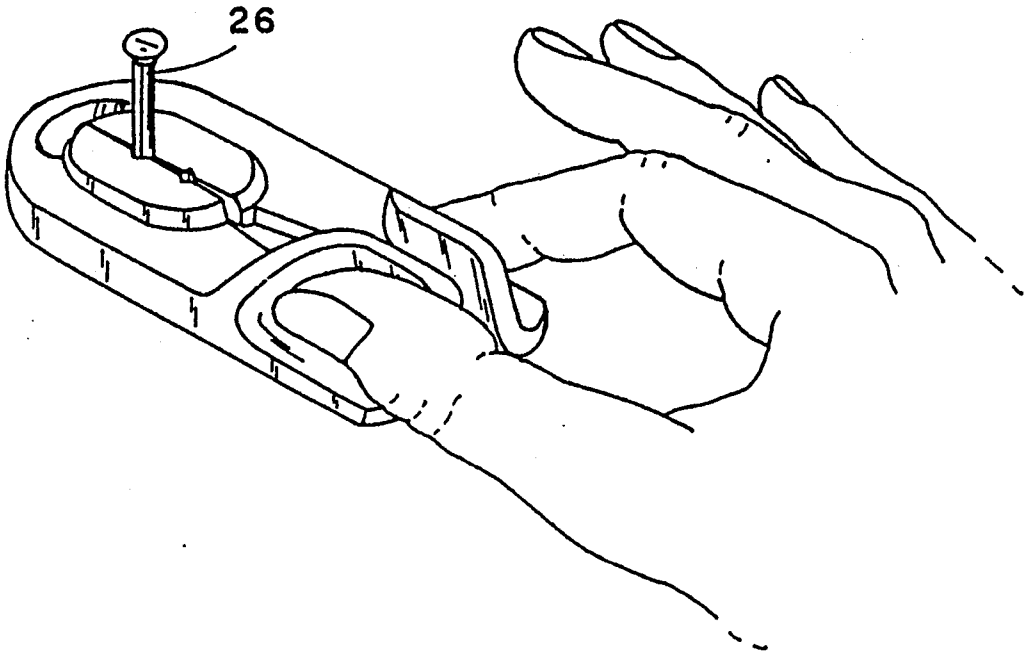
FIG. 11 shows a perspective view of the nail guide of FIG. 9.

Reference is now being had to FIG. 5. As can be seen, each of the elongated members has an inner side face 21, which faces the corresponding inner side face of the other member. The front end 12 has a bore 22 adapted to receive pivot 13 (shown in FIGS. 1 and 2) and is generally shaped so as to cooperate with the other member to provide for a pivot-type connection. If desired, the pivot may also be formed by a cylindrical integral projection at front end 12 of one of the members adapted to be received by a bore in the other member. The front portion 23 of inner side face 21 has two essentially V-shaped grooves 24 and 25, which cooperate with corresponding grooves in the other member to hold and guide a shank of a nail 26 as shown in FIG. 7. As will be explained further below each pair of grooves 24 and of grooves 25 are adapted for holding and guiding shanks of nails of different diameter ranges.

Grooves 24 and 25 in the embodiment shown herein are perpendicular to bottom plane 20 and are thus adapted for holding a nail so as to guide same in a direction perpendicular to a substrate's plane, as shown in FIG. 7. In order to hold and guide a nail in a direction other than perpendicular, the groove may be angled as shown, for example, by dotted lines 27 in FIG. 5.

Figure 6:
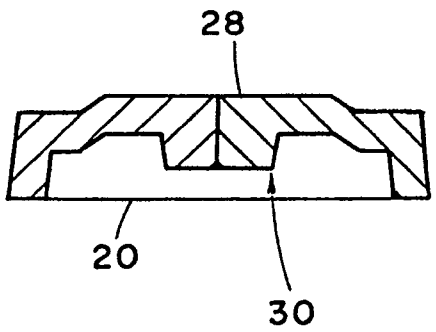
FIG. 6 shows a cross-section through line 6—6 in FIG. 2.

In order to protect front end 12 from damages which can be inflicted by accidental hammer hits, the portion 28 of the upper face of each member flanking the nail holding portion 23 is elevated, e.g. by about 1–2 mm. Furthermore, with reference to FIGS. 5 and 6, it can be seen that a large portion 30 of the bottom face, including the portion opposite the elevated portion 28 of the upper face, is elevated with respect to bottom plane 20.

Reference is now being had to FIG. 7 showing an enlarged view of the front end portion of nail guide. As can be seen, groove 24 is larger than groove 25, the former having a width $w_1$ and a depth$_1$ and the latter having a width $w_2$ and a depth $d_2$. Each pair of grooves is adapted for holding and guiding shanks of nails of a different diameter range.

Nails in common use range in shank's diameter between about 1 to about 3 mm. The pair of grooves 24 is suitably adapted for holding and guiding nails having a shank diameter in the range of 1.6–3.0 mm and the pair of grooves 25 are suitably adapted for holding and guiding nails having a shank diameter in the range of 1.0–1.6 mm. For holding nails' shanks of the aforementioned diameter ranges, groove 24 has suitably a width $w_1$ of about 2.0–2.4 mm, e.g. about 2.2 mm, and a depth $d_1$ of about 0.8–1.0 mm. e.g. 0.9 mm; groove 25 has suitably a width $w_2$ of about 1.2–1.6 mm, e.g. about 1.4 mm, and a depth $d_2$ of about 0.5–0.6 mm, e.g. about 0.55 mm.

As can further be seen in FIG. 7, the grooves are asymmetrical in that the front sides 31 and 32 of grooves 24 and 25, respectively, are slightly longer than their respective rear sides 33 and 34. Such an asymmetric design of the grooves improves the nail guide's grasp of a shank of a nail. Where, for example, groove 24 has a width $w_1$ of about 2.2 mm, projection $f_1$ of side 31 and projection $r_1$ of side 33 may respectively be about 1.2 and 1.0 mm long. Where, for example, groove 25 has a width $w_2$ of about 1.4 mm long, projection $f_2$ of side 32 and projection $r_1$ of side 34 may respectively be about 0.8 and 0.6 mm long.

The nail guide is suitably made of plastic which is preferably transparent at least at portion 28. The nail guide has suitably a total thickness, i.e. distance between about plane 20 and upper face of portion 28, of about 6–8 mm, particularly of about 7 mm, and has suitably a thickness at portion 23 of about 4–6 mm, particularly about 5 mm, which dimensions render the nail guide suitable for most of the nails in common use.

Attention is now being made to FIGS. 9–12 showing a nail guide in accordance with another embodiment of the invention. In FIGS. 9–12 all like elements to those in the embodiment shown in FIGS. 1–8 have been given the same reference numerals with a prime indication and the reader is referred to the description of FIGS. 1–8 for the explanation of their functions. In this embodiment the two members 10' and 11' are connected to one another by means of a flexible connecting member 38. Member 38 biases the two members 10' and 11' from one another but when pressure is applied onto finger grips 14' and 15', members 10' and 11' pivotally rotate with respect to one another about their front end whereby they can hold and "guide" a nail in the same manner as explained above.

I claim:

1. A device for holding and guiding a nail during driving same into a substrate with a hammer, comprising two elongate members pivotally connected to one another at a front end by a connecting means allowing the two members to pivotally rotate with respect to one another about their said front end, and having each a finger grip at a rear end; the two members have upper and bottom faces, the bottom faces defining a bottom plane and having inner side faces one facing the other, at least a portion of the inner side faces proximal to said front end being essentially perpendicular to said bottom plane; said portion of at least one of the members has at least one essentially V-shape groove for holding a shank of a nail, said portion of at least one of the member and said portion of another member being capable of cooperating to hold together a shank of a nail therebetween when the two members are being pressed toward one another; wherein the essentially V-shape groove has a front side and a rear side, and wherein one of those sides is longer than the other of those sides.

2. A device according to claim 1, wherein the connecting means is a pivot cooperating with bored front portions of the two members.

3. A device according to claim 1, wherein the connecting means is a flexible connecting member integral with the front end of the two members.

4. A device according to claim 3, wherein the connecting member biases the two members away from one another.

5. A device according to claim 1, wherein a portion of the upper face of the two members flanking said portions of the inner side faces is elevated above the level of the upper face at the point of connection between the two members.

6. A device according to claim 1, wherein the finger grip has a concave surface formed between bottom, inner side and front walls merging smoothly with one another.

7. A device according to claim 1, wherein said portion of a least one of the members has one or more essentially V-shaped grooves for holding a shank of a nail.

8. A device according to claim 7, wherein each essentially V-shape groove in one member is opposite a corresponding essentially V-shape groove in another member, such pair of essentially V-shape grooves capable of cooperating together to hold a shank of a nail.

9. A device according to claim 7, wherein said portion of at least one of the members comprising a plurality of V-shape grooves each adapted to hold nails of different diameter ranges.

10. A device according to claim 7, wherein the one or more essentially V-shape grooves have each a front side and a rear side, said front side being the side closer to said front end of the device, which is longer than the groove's rear side.

11. A device according to claim 8, having two pairs of grooves, one adapted to hold and guide nails having a shank diameter in the range of about 1–1.6 mm and the other adapted to hold and guide nails having a shank diameter in the range of about 1.6–3 mm.

12. A device according to claim 6, wherein the finger grip is to permit manual grasping to facilitate simultaneously holding the shank of a nail and stabilizing the device against a substrate.

13. A device according to claim 1, further comprising a groove formed by said members for holding a shank of a nail.

14. The device of claim 13, wherein said groove is oriented to hold a shank of a nail in a direction generally perpendicular to said bottom faces.

15. A device according to claim 13, wherein said groove is oriented to hold a shank of a nail generally non-perpendicular relative to said bottom faces.

16. A device for holding and guiding a nail during driving same into a substrate with a hammer, comprising two elongate members pivotally connected to one another at their front end, and having each a finger grip at their other end; the two members have upper and bottom faces, the bottom faces defining a bottom plane and having inner side faces one facing the other, at least a portion of the inner side faces proximal to said front end being essentially perpendicular to said bottom plane; said portion of at least one of the members has at least one or more essentially V-shape grooves for holding a shank of a nail, said portion of one member and said portion of another member capable of cooperating to hold together a shank of a nail therebetween when the two members are being pressed toward one another, wherein the at least one or more essentially V-shape grooves have each a front side and a rear side, said front side being the side closer to said front end of the device, which is longer than the groove's rear side.

17. A device according to claim 16, wherein the finger grip has a concave surface formed between bottom, inner side and front walls merging smoothly with one another.

18. A device according to claim 17, wherein the finger grip is to permit manual grasping to facilitate simultaneously holding the shank of a nail and stabilizing the device against a substrate.

19. A device according to claim 16, wherein each essentially V-shape groove in one member is opposite a corresponding essentially V-shape groove in another member, such pair of essentially V-shape grooves capable of cooperating together to hold a shank of a nail.

20. A device according to claim 16, wherein said portion of at least one of the members comprises a plurality of V-shape grooves each adapted to hold nails of different diameter ranges.

21. A device according to claim 16, wherein a portion of the upper face of the two members flanking said portions of the inner faces is elevated above the level of the upper face at the point of connection between the two members.

22. A device according to claim 19, having two pairs of grooves, one adapted to hold and guide nails having a shank diameter in the range of about 1–1.6 mm and the other adapted to hold and guide nails having a shank diameter in the range of about 1.6–3 mm.

23. A device for holding and guiding a nail during driving same into a substrate with a hammer, comprising two elongate members pivotally connected to one another at a front end by a connecting means allowing the two members to pivotally rotate with respect to one another about their said front end, and having each a finger grip at a rear end; the two members have upper and bottom faces, the bottom faces defining a bottom plane and having inner side faces one facing the other, at least a portion of the inner side faces proximal to said front end being essentially perpendicular to said bottom plane; said portion of at least one of the members has a means for holding a shank of a nail, said portion of at least one of the members and said portion of another member being capable of cooperating to hold together a shank of a nail therebetween when the two members are being pressed toward one another; wherein the finger grip has a concave surface formed between bottom, inner side and front walls merging smoothly with one another, the finger grip is positioned to permit manual grasping to facilitate simultaneously holding the shank of a nail and stabilizing the device against a substrate, and said bottom wall has a portion substantially parallel to said bottom plane and said inner side and front walls have respective portions substantially perpendicular to said bottom plane, and said bottom, inner side and front walls being cooperative in response to application of manual downward pressure thereto toward said bottom plane to stabilize the device against a substrate and of manual grasping pressure urging said finger grips and elongate members toward each other firmly to hold the shank of a nail.

24. A device for holding and guiding a nail during driving same into a substrate with a hammer, comprising two elongate members pivotally connected to one another at their front end, and having each a finger grip at their other end; the two members have upper and bottom faces, the bottom faces defining a bottom plane and having inner side faces one facing the other; at least one of the members has a means for holding a shank of a nail, said members being capable of cooperating to hold together a shank of a nail therebetween when the two members are being pressed toward one another, wherein the finger grip has a concave surface formed between bottom, inner side and front walls merging smoothly with one another, the finger grip being to permit manual grasping to facilitate simultaneously holding the shank of a nail and stabilizing the device against a substrate, and said bottom wall has a portion substantially parallel to said bottom plane and said inner side and front walls have respective portions substantially perpendicular to said bottom plane, and said bottom, inner side and front walls being cooperative in response to application of manual downward pressure thereto toward said bottom plane to stabilize the device against a substrate and of manual grasping pressure urging said finger grips and elongate members toward each other firmly to hold the shank of a nail.

* * * * *